United States Patent [19]

Wahle et al.

[11] 4,413,640

[45] Nov. 8, 1983

[54] APPARATUS FOR TRANSPORTING ROD-SHAPED ARTICLES OF THE TOBACCO PROCESSING INDUSTRY

[75] Inventors: Günter Wahle, Reinbek; Willy Rudszinat, Dassendorf, both of Fed. Rep. of Germany

[73] Assignee: Hauni-Werke Körber & Co. KG, Hamburg, Fed. Rep. of Germany

[21] Appl. No.: 271,970

[22] Filed: Jun. 9, 1981

[30] Foreign Application Priority Data

Jun. 10, 1980 [DE] Fed. Rep. of Germany ..... 3021696

[51] Int. Cl.[3] ..... A24C 5/32; A24C 5/33; A20C 5/35

[52] U.S. Cl. ..... 131/281; 131/282

[58] Field of Search ..... 131/281, 282, 283

[56] References Cited

U.S. PATENT DOCUMENTS 4,099,637 7/1978 Molins ..... 131/282

FOREIGN PATENT DOCUMENTS 1957002 5/1969 Fed. Rep. of Germany ..... 131/282
2546599 4/1975 Fed. Rep. of Germany ..... 131/282
2520116 11/1976 Fed. Rep. of Germany ..... 131/282

*Primary Examiner*—V. Millin
*Attorney, Agent, or Firm*—Kontler, Grimes & Battersby

[57] ABSTRACT

A junction zone between the first and second sections of a conveyor system for sidewise transport of cigarettes or analogous rod-shaped articles communicates with the first opening of a reservoir which normally constitutes a surge bin for temporary storage of those articles which are delivered by the first section but cannot be accepted by the second section. The reservoir has a second opening which is normally separated from the first opening by a reciprocable partition but is free to discharge articles into a tray filling machine when the reservoir is filled to capacity and the rate at which the first section delivers articles continues to exceed the rate at which the second section removes articles from the junction zone.

35 Claims, 5 Drawing Figures

Fig.1
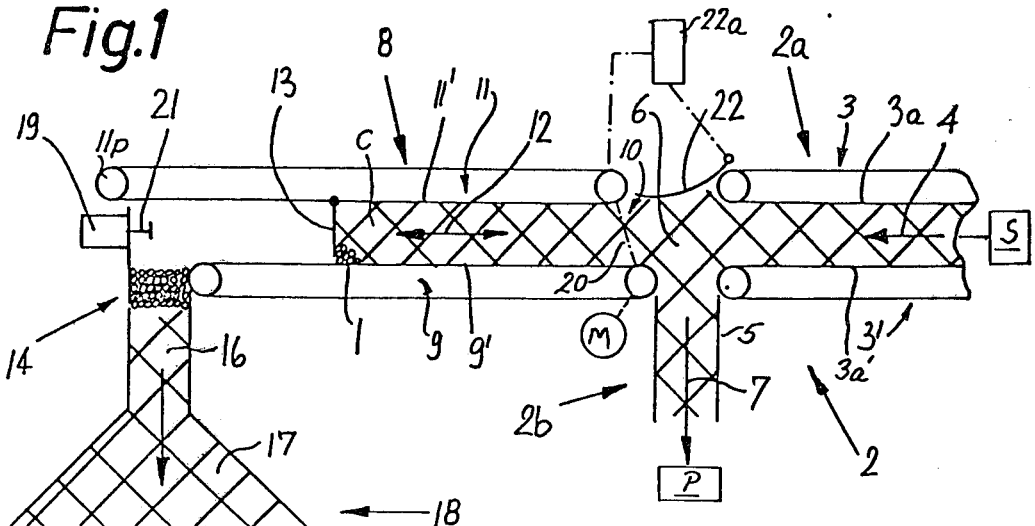
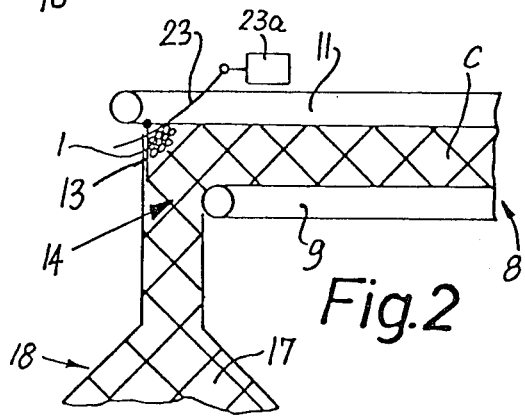
Fig.2
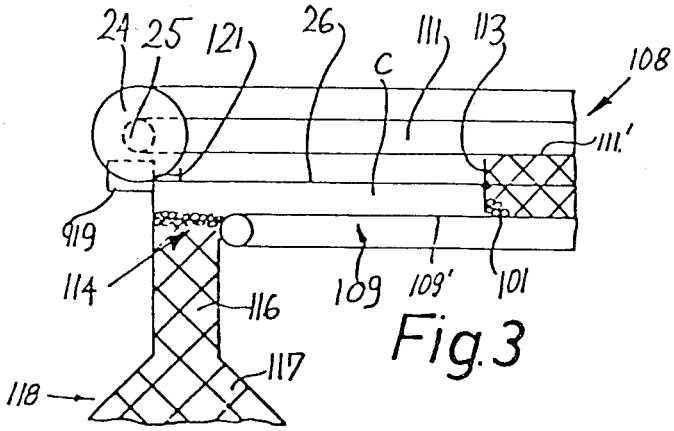
Fig.3

APPARATUS FOR TRANSPORTING ROD-SHAPED ARTICLES OF THE TOBACCO PROCESSING INDUSTRY

BACKGROUND OF THE INVENTION

The present invention relates to apparatus for transporting cigarettes, filter rod sections, cigars, cigarillos or analogous rod-shaped articles which constitute or form part of smokers' products. More particularly, the invention relates to improvements in apparatus for sidewise transport of rod-shaped articles between one or more first machines (e.g., cigarette or filter rod making machines) and one or more second machines (e.g., one or more filter tipping machines). Still more particularly, the invention relates to improvements in apparatus of the type wherein at least one reservoir can take up the surplus of rod-shaped articles when the output of the first machine or machines exceeds the requirements of the second machine or machines and the reservoir or reservoirs assist or replace the first machine or machines in satisfying the requirements of the second machine or machines when such requirements exceed the output of the first machine or machines.

It is already known to combine one or more first-in last-out reservoirs (also called surge bins) with an apparatus which supplies rod-shaped articles from one or more first machines (hereinafter called maker(s) or producing machine(s)) to one or more second machines (hereinafter called processing or consuming machine(s)). Each reservoir has a mobile floor and an end wall which is movable with the floor toward or away from a single inlet-outlet opening of the reservoir. The opening communicates with the path along which the articles move sideways from the producing machine(s) to the processing machine(s), and the floor is set in motion whenever the output of the producing machine(s) exceeds the requirements of the processing machine(s) or vice versa so as to increase the capacity of the respective reservoir when the processing machine(s) cannot accept the entire output of the producing machine(s) and to reduce the capacity of the respective reservoir (and to thus expel articles into the aforementioned path) when the requirements of the processing machine(s) exceed the output of the producing machine(s). Such apparatus can be used with advantage between producing machines which turn out plain or filter tipped cigarettes, cigars or cigarillos or simple or multiplex filter rod sections and processing machines which pack or produce multiplex filters, filter tipped cigarettes, cigars or cigarillos.

It is often desirable to directly couple at least one producing machine (e.g., a filter rod making machine which turns out filter rod sections of selected length) with at least one processing machine (e.g., a filter tipping machine wherein filter rod sections and plain cigarettes are united or assembled to form filter cigarettes of unit length or multiple unit length). Alternatively, plain cigarettes or filter cigarettes are often transported directly to a packing machine. This creates problems in the event of malfunctioning of the producing or processing machine because, in the absence of a suitable reservoir system, each (even very short-lasting) stoppage of the producing machine necessitates an immediate stoppage of the processing machine or vice versa. German Offenlegungsschrift No. 25 20 116 discloses a surge bin which can accept a portion or the entire output of one or more producing machines when the processing machine(s) cannot accept any or cannot accept all of the produced articles. The mobile floor of the surge bin is set in motion when a suitable sensor ascertains that the output of the producing machine(s) is excessive or that the requirements of the processing machine(s) exceed the output. The position of the end wall which is attached to the mobile floor determines the momentary capacity of the surge bin. It has been found that surge bins of the just outlined character are capable of compensating for short-lasting deviations between the output of one or more producing machines and the requirements of one or more processing machines. However, it is necessary to resort to extremely large, bulky and expensive surge bins when the deviations between the output of the producing machine(s) and the requirements of the processing machine(s) are substantial, especially when each producing machine can turn out at least one hundred articles per second and the requirements of each processing machine can amount to several hundred articles per second. The complexity of large surge bins rises proportionally with the lack of space or with the lack of space in immediate proximity to the shortest path between the producing machine(s) and the processing machine(s). For example, German Auslegeschrift No. 25 46 599 discloses a surge bin with a zig-zag shaped mobile floor, and German Offenlegungsschrift No. 19 57 002 discloses a surge bin having a floor whose sections form several superimposed loops. This contributes to the cost of the surge bin and renders it prone to malfunctioning because the transport of rod-shaped articles along a zig-zag shaped, meandering or like complex path affords numerous additional opportunities for jamming as a result of crushing of one or more conveyed articles, pronounced wear upon the moving parts of the surge bin, problems in connection with suspension or other form of mounting the component parts of the surge bin, absence of convenient access to certain portions of the surge bin and/or the impossibility of entrusting the maintenance, supervision or repair work to semiskilled or unskilled attendants.

OBJECTS AND SUMMARY OF THE INVENTION

An object of the invention is to provide a novel and improved apparatus for transport of rod-shaped articles which constitute or form part of smoker's products, and to provide the apparatus with a novel and improved reservoir for temporary storage or diverting of the surplus of supplied articles.

Another object of the invention is to provide the apparatus with novel and improved means for normally sealing an alternate receiving means for the surplus of rod-shaped articles from the primary path of such articles.

A further object of the invention is to provide an apparatus which can take care of short-lasting and relatively small differences between the output of one or more producing machines and the requirements of one or more processing machines as well as of longer-lasting or long-lasting small, medium or large differences between the output and the requirements.

An additional object of the invention is to provide a relatively simple apparatus of the above outlined character which treats the articles gently, which occupies little room, which can receive articles from one or more conventional producing or making machines and which can deliver articles to several discrete processing machines or several groups of processing machines.

Another object of the invention is to provide a novel and improved first-in last-out reservoir for use in an apparatus of the above outlined character.

An ancillary object of the invention is to provide the above outlined apparatus with a reservoir which can be used as a surge bin and/or as a first-in first-out reservoir.

Still another object of the invention is to provide the apparatus with novel and improved means for shifting to an alternate or secondary mode of evacuation of articles when the primary destination is not accessible to conveyed articles.

A further object of the invention is to provide an apparatus which can be used as a more compact, more versatile and more reliable substitute for presently known apparatus serving to deliver rod-shaped articles from one or more makers to one or more processing machines and to automatically compensate for deviations of the output of the maker(s) from the requirements of the processing machine(s).

An additional object of the invention is to provide the apparatus with novel and improved means for accepting the entire output of one or more makers during temporary or long-lasting stoppage of the processing machine or machines.

One feature of the invention resides in the provision of an apparatus for transport and temporary storage of rod-shaped articles, such as filter rod sections or plain or filter cigarettes, cigars or cigarillos. The apparatus comprises a reservoir including wall means defining a chamber (preferably an elongated substantially horizontal chamber of constant or nearly constant height) having spaced apart first and second openings. The wall means comprises a partition disposed in the chamber and movable between plural first positions intermediate the two openings and at least one second position in which the openings are free to communicate with one another. The apparatus further comprises conveyor means defining an elongated path communicating with the first opening and having first and second portions respectively located upstream and downstream of the first opening. The conveyor means includes first and second sections which are respectively constructed and assembled to advance articles sideways at first and second variable rates along the first and second portions of the path. Still further, the apparatus comprises means for moving the partition between the first positions to thereby permit entry of articles into and effect evacuation of articles from the chamber by way of the first opening when the difference between the first and second rates is within a given range (namely, a range within which the reservoir is empty or is partially or completely filled but not overfilled), as well as to permit evacuation of articles from the path by way of the first opening, the chamber and the second opening when the difference between the two rates is outside of the given range (namely, when the reservoir is already filled but the chamber continues to receive articles by way of the first opening because the first rate continues to exceed the second rate).

The wall means and the conveyor means define a junction zone or junction forming an intermediate portion or part of the aforementioned path and communicating with the chamber of the reservoir by way of the first opening.

Another feature of the invention resides in the provision of a reservoir, particularly for rod-shaped articles which constitute or form part of smokers' products. The reservoir comprises wall means defining a preferably elongated chamber having spaced-apart first and second openings and including a partition normally disposed in the chamber and movable between a plurality of first positions in each of which the partition separates the first and second openings from each other and at least one second position in which the openings communicate with one another, and means for moving the partition between such positions. The wall means preferably comprises an endless conveyor which constitutes a mobile floor and is movable in synchronism with the partition to facilitate entry of articles into or evacuation of articles from the chamber by way of the first opening. The conveyor may constitute a belt conveyor having an upper reach which extends between the two openings. One of the openings is or may be located at the general level of and the other opening may be located at a level above the upper reach. The partition preferably includes a deformable lower portion which contacts the upper reach in the first positions of the partition.

The novel features which are considered as characteristic of the invention are set forth in particular in the appended claims. The improved transporting apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic fragmentary side elevational view of an apparatus which embodies one form of the invention and serves to deliver rod-shaped articles of the tobacco processing industry from one or more producing machines to one or more processing machines and/or to one or more further processing or storing machines, e.g., to a tray filling apparatus;

FIG. 2 is a similar fragmentary schematic side elevational view of a second apparatus with a different monitoring device at the second outlet of the reservoir;

FIG. 3 is a similar fragmentary schematic side elevational view of a third apparatus wherein the mobile end wall is not attached to the conveyors defining the chamber or compartment of the reservoir;

DESCRIPTION OF THE PREFERRED EMBODIMENTS

Figure 4:
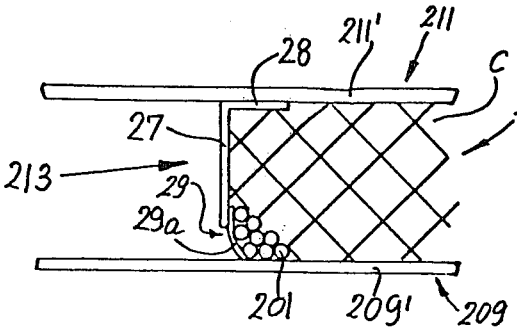
FIG. 4 is a fragmentary side elevational view of a reservoir having an end wall a portion of which is deformable.

FIG. 1 illustrates an apparatus for transporting a multi-layer stream of parallel rod-shaped articles 1 (such as plain cigarettes, filter cigarettes or filter rod sections) sideways, i.e., at right angles to their respective axes. The apparatus comprises a conveyor system 2 having two mutually inclined branches 2*a* and 2*b*. The branch or section 2*a* delivers articles 1 along a substantially horizontal first portion of an elongated path as indicated by the arrow 4 and includes two endless belt conveyors 3 and 3' having parallel article-engaging or contacting inner reaches 3*a* and 3*a*' respectively. These reaches flank the first path portion and advances a multi-layer stream of articles 1 which can be supplied by a cigarette making machine, by a filter rod making machine or by a filter tipping machine. A maker or source of rod-shaped articles 1 is shown schematically at S; this source may constitute or include at least one of the just mentioned machines but its construction or the mode of its operation forms no part of the present invention. If the producing machine S is a filter tipping machine, it may be of the type known as MAX S which is manufactured and sold by the assignee of the present application. If the machine S is the maker of filter rod sections, it may be of the type known as KDF, also made and distributed by the assignee of the present application. If the maker S is designed to furnish plain cigarettes, it may be of the type known as GARANT or SE, both made and sold by the assignee of the present application.

The section or branch **2*b* defines a substantially vertical second portion of the path (as indicated by the arrow 7) for articles 1 and serves to convey the articles sideways into the magazine of at least one processing machine P. For example, the processing machine P may constitute a filter tipping machine if the machine S produces plain cigarettes or filter rod sections which are respectively united with filter rod sections or plain cigarettes in the machine P to form filter cigarettes. If the producing machine S is a filter tipping machine, the processing machine P may constitute a packing machine, e.g., a machine of the type known as COMPAS made and sold by the assignee of the present application. The branch or section 2*b* may constitute or include a simple conveyor in the form of a vertical chute or duct 5 wherein the articles 1** descend by gravity in order to advance into the magazine of the processing or consuming machine P.

During travel through a junction or junction zone 6 between the branches **2*a* and 2*b* of the conveyor system 2 (i.e., between the first and second portions of the path along which the articles 1 normally advance from the producing machine S to the processing machine P), the articles 1 are caused to change the direction of their movement from that indicated by the arrow 4 to that which is indicated by the arrow 7. The change in direction of movement may amount to approximately or exactly 90 degrees. The duct or chute 5 of the branch or section 2*b* may deliver articles to two or more discrete processing or consuming machines. By the same token, the section 2*a* can receive articles 1** from one or more makers or producing machines.

The second section 8 of the apparatus shown in FIG. 1 comprises or constitutes what can be termed a novel version of a first-in last-out reservoir or surge bin. It comprises an endless belt or chain conveyor 9 whose upper reach 9' is substantially or exactly horizontal and may but need not be aligned with the upper reach **3*a*' of the conveyor 3. A reversible electric motor M can move the upper reach 9' in the directions indicated by a double-headed arrow 12, depending upon whether the reservoir 8 is to accept the surplus of articles 1 which are fed by the section 2*a* but cannot be accepted by the section 2*b* or whether the reservoir 8 is to deliver articles 1 to the junction 6** because the requirements of the processing machine P exceed the output of the producing machine S.

The reservoir 8 has a compartment or chamber C which is located between the upper reach 9' of the endless belt conveyor 9 and the lower reach 11' of a second endless belt or chain conveyor 11 which is mounted at a level above the conveyor 9 and is preferably driven by the motor M is synchronism with the conveyor 9, i.e., the reaches 9' and 11' always travel in the same direction (to the right or to the left, as viewed in FIG. 1) when the motor M is on. The operative connection between the conveyors 9 and 11 is indicated by a phantom line 20. The height of the horizontal chamber C which is defined by the reaches or walls 9' and 11' of the conveyors 9 and 11 may but need not be constant and may but need not match the height of the path portion between the conveyors 3 and 3' or the width of the duct or chute 5 in the section **2*b***.

The reservoir 8 further comprises a reciprocable partition or end wall 13 which is rigidly or articulately connected with the lower reach or wall 11' so as to be capable of pushing articles through a first opening 10 of the reservoir 8 and into the junction 6 when the reach 11' is caused to advance in a direction to the right, as viewed in FIG. 1.

In accordance with a feature of the invention, the reservior 8 has two openings, namely, the aforesaid (inlet-outlet) opening 10 at the junction 6 and a second opening 14 which becomes exposed (accessible to the articles 1) when the partition 13 is caused to move to the left and at least slightly beyond the left-hand end turn of the lower conveyor 9. It will be noted that the lower reach 11' of the conveyor 11 is somewhat longer than the upper reach 9' of the conveyor 9; at any rate, the lower reach 11' can move the partition 13 to one or more (second) positions in which the opening 10 between the reaches 9' and 11' is free to communicate with the second opening 14 so that the contents of the reservoir 8 can be evacuated, at the rate at which the opening 10 receives articles 1 from the junction 6, by way of the opening 14 and into a suitable storing apparatus, e.g., into an apparatus 18 which serves to fill conventional chargers or trays **18*a* for rod-shaped articles constituting or forming part of smokers' products. The tray filling apparatus 18 comprises or is combined with a duct or chute 16 which constitutes a conveyor serving to advance or to permit advancement of articles issuing from the magazine 8 along a vertical path and via second opening 14 into a downwardly diverging inverted-funnel-shaped tray filling device 17**.

The apparatus of FIG. 1 further comprises means for monitoring the position of the partition 13, at least during those stages of operation when the second opening 14 is free to receive articles 1 from the major part of the chamber C of the reservoir 8. The illustrated monitoring means comprises an electric or electronic switch 19 having a mobile actuating element 21 which extends into the path of movement of the partition 13 to the latter's left-hand end position or second position. The arrangement may be such that the actuating element 21 causes the monitoring device 19 to generate a signal only when the partition 13 reaches its left-hand end position.

A sensor, e.g., a substantially U-shaped lever 22 which rests on the supply of articles at the junction 6, is provided to actuate the motor M. The sensor 22 is connected with the motor M by way of a suitable control circuit **22*a* which starts the motor M in one direction when the supply of articles 1 at the junction 6 rises above a predetermined upper or first level and which starts the motor M in the opposite direction when the supply of articles 1 at the junction 6 descends below a predetermined lower or second level. The parts M, 20, 22, 22*a* constitute a means for moving the conveyors 9** and 11 in synchronism so as to move the partition 13 between a plurality of first positions (the partition is then located between the openings 10, 14) and at least one second position in which the opening 14 is free to communicate with the junction 6 via opening 10 and chamber C. The reach 9' is a mobile floor of the chamber C and the reach 11' can be said to constitute a combined guide means and motion transmitting means for the partition 13. Furthermore, the conveyor 11 is a mobile roof of the chamber C. The openings 10, 14 are located at the respective ends of the chamber C. However, it is also possible to provide two or more second openings, depending upon whether or not the manufacturer desires to increase or reduce the capacity of the chamber C when the reservoir 8 is used as a surge bin. For example, a sealable additional second opening can be provided between the illustrated openings 10, 14 by the simple expedient of replacing the conveyor 9 with a composite conveyor and by providing a removable bridge which extends across the additional second opening when the latter is not in use, i.e., when the entire reservoir is to be used as a surge bin during normal operation of the machines S and P (namely, when the machine P can accept the output of the machine S) while the partition 13 is idle or moves back and forth but need not move to its second position).

The operation of the apparatus which is shown in FIG. 1 is as follows:

When the rate at which the producing machine or maker S delivers rod-shaped articles 1 into the path portion between the conveyors 3, 3' of the section 2*a* matches the rate at which the machine P processes or consumes the articles 1 supplied via junction 6 and path portion defined by the section 2*b*, the partition 13 remains idle in one of its first positions and the entire output of the machine S is conveyed to the machine P. The position of the sensor 22 also remains unchanged so that the motor M is idle and the volume of that portion of the chamber C which extends between the reaches 9', 11' of the conveyors 9, 11 and the partition 13 of the reservoir 8 remains unchanged. In other words, all of the articles 1 which are admitted into the first path portion by moving sideways in the direction of arrow 4 leave the apparatus by advancing in the direction (i.e., along the second path portion) which is indicated by the arrow 7.

If the rate at which the machine or maker S delivers articles 1 toward the junction 6 is higher than the rate of article transport in the direction of arrow 7, the sensor 22 is pivoted in a clockwise direction, as viewed in FIG. 1, and the motor M is started to move the reaches 9' and 11' in a direction to the left, as viewed in FIG. 1, whereby the partition 13 moves away from the junction 6 and opening 10 and thereby increases the capacity of the chamber C. Initially, the reservoir 8 performs the function of a surge bin (i.e., the function of a first-in last-out reservoir) because the partition 13 is assumed to be remote from the second opening 14 so that the reservoir 8 merely accepts a relatively small surplus of articles, i.e., those articles which cannot enter the duct or chute 5 of the section 2*b* because the requirements of the machine P do not match the output of the machine S.

If the output of the machine S does not match the requirements of the machine P, the level of the upper surface of the supply of articles 1 at the junction 6 descends, i.e., the sensor 22 is caused to pivot in a counterclockwise direction, as viewed in FIG. 1, and the control unit 22*a* causes the motor M to drive the conveyors 9, 11 in the opposite direction so that the partition 13 moves toward the opening 10 and junction 6 and the reservoir 8 assists the maker S in meeting the requirements of the machine P. Thus, the capacity of the chamber C is reduced. As a rule, the partition 13 will move back and forth between a plurality of first positions, i.e., the reservoir 8 will normally store a certain quantity of parallel articles 1 regardless of whether the rate at which the machine S turns out articles 1 exceeds or is less than the rate at which the articles are processed by the machine P. The length of the reservoir R and/or other dimensions of this reservoir are preferably selected in such a way that the reservoir can compensate for short-lasting or relatively short-lasting differences between the output of the machine S and the requirements of the machine P, irrespective of whether the requirements of the machine P are higher or lower than the output of the machine S.

However, when the output of the machine S exceeds the requirements of the machine P for a relatively long interval of time, or when the difference between the output of the machine S and the requirements of the machine P is very pronounced (e.g., in response to stoppage of the machine P), the partition 13 of the reservoir 8 continues to move in a direction to the left, as viewed in FIG. 1, and ultimately exposes at least a portion of the second opening 14 so that the reservoir 8 can discharge cigarettes into the tray filling apparatus 18. The extent of leftward movement of the partition 13 may be such that the latter actuates the signal generating device 19 by fully or partially depressing the actuating element 21. The device 19 sets in motion the moving parts of the tray filling apparatus 18 so that the latter begins to introduce rod-shaped articles 1 into successive trays 18*a*. The moving parts of the apparatus 18 may comprise a mechanism for delivering successive empty trays 18*a* to a station below the device 17 and for removing successive filled trays from such station. Furthermore, the apparatus 18 may include means for agitating the contents of the device 17 so as to ensure uninterrupted descent of a stream of articles 1 into the tray 18*a* at the receiving station. An apparatus which can be used to receive articles 1 from the second opening 14 of the reservoir 8 is disclosed, for example, in commonly owned U.S. Pat. No. 3,308,600 granted Mar. 14, 1967 to Otto Erdmann et al. (it will be noted, however, that the apparatus of Erdmann et al. is designed to receive rod-shaped articles which advance by moving sideways along a horizontal path).

The output of the apparatus 18 can be readily selected in such a way that it can process the entire output of the machine S, even if the machine P is or remain idle for extensive or very long periods of time.

It will be noted that the reservoir 8 performs several functions including compensating for short-lasting deviations of the output of the machine or machines S from the requirements of the machine or machines P, as well as for enabling the surplus of articles 1 to reach the apparatus 18 when the machine or machines P are idle or when their operation is reduced to such an extent that at least a certain percentage of the output of the machine or machines S reaches the second opening 14 and thence the duct or chute 16 of the tray filling apparatus 18. As mentioned above, the apparatus 18 is capable of accepting the entire output of the machine or machines S so that the machine or machines S can remain in operation (by feeding articles to the apparatus 18) for practically unlimited periods of time and certainly for periods which are normally required to eliminate the anticipated causes of malfunction of the machine or machines P. Consequently, the apparatus of the present invention can be used for direct coupling of mass-producing machines with mass-processing machines without necessitating even temporary stoppage of the producing machine or machines (S) in the event of short- or long-lasting malfunctioning of one or more mass-processing machines which normally receive articles from the section 2*b* of the conveyor system 2. In the absence of the second opening 14 and the resulting possibility of admitting the surplus of articles into the apparatus 18, the dimensions of the reservoir 8 would have to be increased considerably if this reservoir were to tkae up the output of one or more mass-producing machines S while the processing machine or machines P are idle or operate only at a small fraction of normal speed. In many cigarette making and like plants, the space is at a premium so that the construction of relatively large or very large reservoirs close to the producing and/or processing machine is plain impossible.

The apparatus of FIG. 1 is susceptible of many modifications. For example, the opening 14 can be disposed between the conveyors 9, 11 if the partition 13 is movable about the left-hand end turn (pulley 11*p*) of the conveyor 11. The duct 16 is then replaced by a horizontal conveyor which advances articles 1 sideways to the tray filling station. Also, the opening 14 can be parallel with the plane of FIG. 1 if the apparatus is provided with a suitable pusher or a series of pushers for moving the articles 1 axially during transport through and beyond the opening 14. The placing of the opening 14 in the plane of and to the left of the upper reach 9' is preferred at this time. The reaches 9' and 11' are preferably parallel to each other, and these reaches are preferably horizontal or substantially horizontal. As stated above, the moving means M, 20, 22, 22*a* is designed to synchronize all movements of the floor coveyor 9 with the movements of the conveyor 11 and the partition 13 to thus ensure that the articles 1 are treated gently during introduction into or evacuation from the chamber C via first opening 10 at the right-hand end of the upper reach 9' (i.e., while the partition 13 assumes one of its first positions between the openings 10, 14) as well as during evacuation of articles 1 from the path indicated by arrows 4, 7 by way of opening 10, chamber C and opening 14 (i.e., while the partition 13 assumes at least one second position in which the opening 14 is free to communicate with the opening 10).

The apparatus of the present invention preferably contitutes an overhead conveyor-reservoir system so that the machines(s) P and apparatus 18 can be installed at the floor level. This is especially desirable if the chamber C is long or very long because adequate space for a long reservoir is more readily available at a level above the floor in a tobacco processing plant. The reservoir 8 can be placed at such a level above the floor that the machine P, the machine S and/or the apparatus 18 can be installed and readily accessible therebelow to thereby save floor space in the plant.

The conveyor or duct 16 (i.e., the vertical path between the second opening 14 and the actual storing means for articles 1) can be omitted if the upper end of the device 17 is placed into immediate or close proximity of the opening 14.

The provision of the monitoring means 19 renders it possible to automatically start the storing apparatus 18 only when the need for removal of articles 1 from the conveyor system 2 by way of the reservoir 8 arises. The apparatus 18 is arrested as soon as the partition 13 is disengaged from the actuating element 21 or with an appropriate delay so that a freshly filled tray 18*a* can be removed from the article receiving station.

The control unit 22*a* preferably arrests the machine P when the partition 13 moves all the way to the opening 10 and the sensor 22 continues to descend, i.e., when the reservoir 8 plus the machine S are incapable of meeting the requirements of the machine P. Alternatively, the control unit 22*a* can reduce the speed of the machine P in one or more stages prior to complete stoppage. This is desirable to ensure that the machine P remains in operation when the reservoir 8 is empty but the machine S continues to deliver articles 1 (at less than normal rate).

FIG. 2 illustrates a portion of a second apparatus. The monitoring means 19 of FIG. 1 is replaced with a monitoring means which comprises a pivotable actuating element or sensor 23 installed in the path of leftward movement of the end wall or partition 13 and serving to initiate the operation of the tray filling or an analogous apparatus 18 when the partition 13 exposes a certain portion of or the entire second opening 14. The sensor 23 forms part of or transmits signals to a control unit 23*a* which sets the moving parts of the apparatus 18 in motion when the opening 14 receives articles 1 from the chamber C between the conveyors 9 and 11 of the reservoir 8. The apparatus 18 of FIG. 1 or 2 can be replaced with other suitable apparatus which can accept and store or otherwise process large quantities of rod-shaped articles 1 per unit of time and for extended periods of time. For example, the apparatus 18 can be replaced with an apparatus which serves to pneumatically propel rod-shaped articles (such as sections of filter rods) into the magazines of an entire battery of filter tipping machines or to a remote tray filling apparatus, i.e., to a tray filling apparatus which is not immediately adjacent to the opening 14.

The sensor 23 of FIG. 2 tends to assume its normal position (in which the opening 14 is sealed from the filled portion of the chamber C) under the action of gravity and/or under the bias of a suitable spring, not shown. It will be noted that the sensor 23 can be lifted by the partition 13 when the latter is adjacent to the left-hand side wall of the chute 16 or by the articles 1.

FIG. 3 illustrates a further modification of the apparatus which is shown in FIG. 1. This apparatus employs a reservoir 108 with a modified reciprocable end wall or partition 113 which is movable by a discrete transporting means in the form of an endless flexible element (e.g., a chain 26) trained over suitable rotary guide members (sprockets if the flexible element 26 is a chain, pulleys if the flexible element 26 is a belt) 24 of which only one can be seen in FIG. 3. The lower reach of the flexible element 26 is parallel to the reaches 109' and 111' of the endless belt conveyors 109, 111 of the reservoir 108. The reference numeral 25 denotes the shaft of the rotary guide member 24 for the flexible element 26 as well as the pulley for the left-hand end turn of the upper belt conveyor 111.

The upper belt conveyor 11 or 111 of the reservoir 8 or 108 constitutes an optional feature of the invention, especially in the embodiment of FIG. 3. Alternatively, the conveyor 11 or 111 can be replaced with a stationary plate-like cover for the articles 1 or 101 in the reservoir 8 or 108.

The endless flexible element 26 is preferably a composite element which consists of two endless chains disposed in two parallel vertical planes at the opposite sides (laterally) of the chamber C of the reservoir 108. The partitiona 113 resembles a paddle which is attached to both chains and is located between the just mentioned vertical planes. As stated above, the chain or chains of the endless flexible element 26 can be replaced by one or more toothed or otherwise configurated belts without departing from the spirit of the invention. The monitoring means 119 and its actuating element 121 correspond to the similarly referenced parts shown in FIG. 1. The same holds true for the second opening 114 of the reservoir 108 and the parts 116, 117 of the apparatus 118.

FIG. 4 illustrates a modified partition or end wall 213 in a reservoir 208. The partition 213 includes a rigid L-shaped component or portion 27 which is secured to the lower reach 211' of the upper conveyor or guide means 211, and a flexible (deformable) lower component or flap 29 which is separably or permanently attached to the lower portion of the component 27 and sweeps along the upper side of the upper reach 209' of the lower conveyor 209 in the reservoir 208. The reference character 28 denotes the upper portion or leg which forms part of the component 27 and is permanently or separably attached to the reach 211'. The flap 29 may consist of rubber, textile material, a synthetic plastic material or a combination of such substances. Furthermore, the flap may constitute a simple brush whose bristles **29*a* are attached to the component 27 at their upper ends while the lower ends of the bristles 29*a* contact the reach 209' except when the partition 213 is held in the fully retracted (second) position so that the chamber C communicates with the second opening corresponding to the second opening or outlet 14 or 114, not shown in FIG. 4. The flexible component or flap 29 reduces the likelihood of damage to articles 201 which are in the process of leaving the chamber C and entering the second opening 14 or 114 during movement of the partition 213 toward or from its left-hand end position or second position. The likelihood of damage to rod-shaped articles (such as plain or filter cigarettes) is more pronounced when the upper conveyor of the reservoir begins to move the partition from the left-hand end position, namely, from that (second) position in which the partition allows articles to enter the second opening of the reservoir. The provision of flexible component 29 reduces the likelihood of damage to the articles practically to zero because the flap can yield and allows the articles which are immediately adjacent to the left-hand end turn of the lower conveyor 209 to continue to move into the second opening or gently sweeps such articles further back into the chamber C. Moreover, the flap 29 can gently sweep over the articles in the filled duct 16 of the apparatus 18 (see FIG. 1 which shows that the duct 16 is normally filled with articles 1 all the way to the level of the opening 14 and of the upper reach 9' even when the partition 13 seals or separates the opening 14 from the opening 10**.

Figure 5:
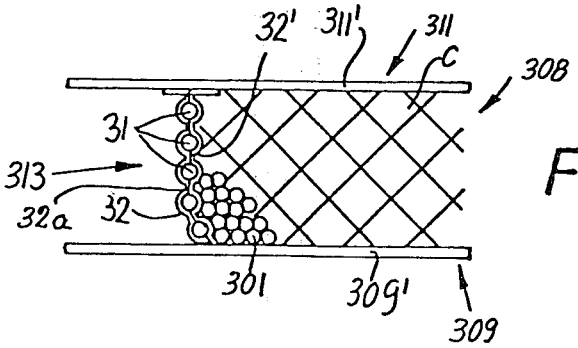
FIG. 5 is a fragmentary side elevational view of a reservoir having a deformable end wall constituting a modification of the end wall shown in FIG. 4.

FIG. 5 shows a portion of a further reservoir 308 with an upper conveyor 311 having a lower reach or wall 311' above the chamber C, a lower conveyor 309 having an upper reach or wall (mobile floor) 309' below the chamber C, and an end wall or partition 313. The partition 313 comprises a plurality of parallel rod-like members 31 which are also parallel to articles 301 in the chamber C and are articulately connected to each other by a curtain or shade, for example, a curtain consisting of two foils or layers 32 and 32' of metallic or plastic foil which are bonded to each other at **32*a*, i.e., in the regions between the neighboring rod-like members 31. It is equally possible to replace the layers 32, 32' with flexible members in the form of textile bands, rubber bands, bands consisting of synthetic plastic material or a combination of such components (e.g., a flexible layer 32 or 32' at one side of the row of parallel rod-like members 31 and one or more textile bands or the like in lieu of the other layer). The component including the layers 32, 32' or equivalents thereof can define a plurality of parallel pockets for insertion of removable rod-like members 31**.

The advantages of the partition 313 are similar or analogous to those of the partition 213 shown in FIG. 4. Thus, the partition 313 can readily yield to prevent damage to articles 301 which are adjacent to the left-hand end turn of the conveyor 309 at the time the partition 313 is close to the second opening (not shown in FIG. 5) of the reservoir 308. In fact, the partition 213 or 313 is also capable of reducing the likelihood of damage to articles 201 or 301 while the second opening of the reservoir 208 or 308 is completey sealed or separated from the first opening, i.e., at such times when the reservoir performs the function of a surge bin. The rod-like members 31 of the partition 313 shown in FIG. 5 exhibit the additional advantage that they promote retention of articles 301 in exact or substantial parallelism with one another, i.e., they hold the articles 301 from lying askew on the upper reach 309'. Improper orientation could result in damage to an entire batch of articles and/or clogging of the reservoir 308.

An important advantage of the improved apparatus is that the reservoir can serve or be operated as a conventional surge bin, i.e., as a first-in last-out reservoir, during normal operation of the machines which supply articles to and receive articles from the path defined by the conveyor system 2, namely, when the rate at which the machine or machines S deliver articles to the first portion of the path defined by the conveyor system 2 does not appreciably deviate from the rate at which the articles are transported along the second portion of the path defined by the conveyor system 2 and on to the machine or machines P, and also when the deviation between the two rates is not prolonged and not one-sided (i.e., not continuously such that the output of the machine or machines S exceeds the requirements of the machine or machines P or vice versa). At the same time, the apparatus can ensure adequate processing of all articles which are produced in recent types of high-speed or ultra high-speed machines for the making of cigarettes, filter rod sections or like articles and are to be processed in equally fast processing or consuming machines. This is due to the fact that, when the difference between the aforementioned rates is outside of a given range, the partition of the reservoir establishes a path for the travel of articles from the first to the second opening of the reservoir, and such articles can enter a storing or like apparatus which receives articles from the second opening. The dimensions of the reservoir need not exceed those of heretofore known reservoirs because the improved reservoir need not store large or very large quantities of parallel rod-shaped articles. This is due to the fact that, when the differences between the rate of delivery of articles by the section **2*a* and the rate of removal of articles by the section 2*b* of the conveyor system 2 are outside of a given range (this definition is intended to embrace very pronounced differences between the two rates as well as long-lasting but perhaps minor differences between such rates), the articles which are delivered subsequent to filling of the reservoir and at such a rate that all of them cannot be processed by the machine or machines P simply pass through the reservoir, which then acts not unlike a first-in first-out reservoir, and enter the secondary processing apparatus or machine, such as the tray filling apparatus 18 or 118. The length of intervals during which the reservoir can perform the function of a first-in first-out reservoir is unlimited, i.e., the operators can intentionally deactivate the machine or machines P and decide to use the apparatus exclusively as a means for transporting rod-shaped articles from the machine or machines S to the apparatus 18 or 118**.

Another important advantage of the improved apparatus is that it treats the articles gently so that the articles are not likely to be deformed, to lose particulate material at their ends and/or to break open during transport through the conveyor system and/or the reservoir. The provision of a partly or completely flexible partition contributes to gentle treatment of articles, the same as synchronization of movements of the mobile floor of the chamber C with movements of the guide means for the partition. Also, the apparatus is very simple, compact and inexpensive. It can be installed in existing plants as a superior substitute for heretofore known apparatus of much greater complexity, e.g., those which employ reservoirs with spiral chambers for temporary storage of rod-shaped articles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for transport and temporary storage of rod-shaped articles which are supplied by at least one first variable-output machine and are normally processed by at least one second variable-output machine, comprising a reservoir including wall means defining a chamber having spaced apart first and second openings, said wall means comprising a partition disposed in said chamber and movable between plural first positions intermediate said openings and at least one second position in which said openings communicate with each other; conveyor means defining an elongated path communicating with said first opening and having first and second portions respectively located upstream and downstream of said first opening, said conveyor means including first and second sections respectively arranged to advance rod-shaped articles sideways at first and second variable rates along said first and second portions of said path, said first and second rates being respectively functions of the output and requirements of said first and second machines; and means for moving said partition between said first positions to thereby permit entry of articles into and effect evacuation of articles from said chamber via said first opening when the difference between said first and second rates is within a given range such that said partition assumes one of said first positions, as well as to permit evacuation of articles from said path by way of said first opening, said chamber and said second opening when the difference between said rates is outside of said given range so that the partition assumes said second position.

2. The apparatus of claim 1, wherein said wall means and said conveyor means define a junction zone forming part of said path, being disposed between the first and second portions of said path and communicating with said chamber by way of said first opening.

3. The apparatus of claim 2, wherein said wall means further comprises a mobile floor for said chamber and said moving means includes means for moving said floor in synchronism with said partition.

4. The apparatus of claim 2, wherein said chamber has first and second ends and said first and second openings are respectively located at the first and second end of said chamber.

5. The apparatus of claim 2, further comprising guide means for said partition.

6. The apparatus of claim 5, wherein said guide means forms part of said wall means.

7. The apparatus of claim 5, wherein said guide means forms part of said moving means.

8. The apparatus of claim 2, wherein said moving means includes a portion of said wall means.

9. The apparatus of claim 2, wherein said wall means further comprises an elongated conveyor movable back and forth to deliver articles from said junction zone into said chamber by way of said first opening when said first rate exceeds said second rate and to evacuate articles from said chamber by way of said first opening when said second rate exceeds said first rate, said moving means including means for moving said elongated conveyor in synchronism with said partition.

10. The apparatus of claim 9, wherein said moving means comprises a second elongated conveyor which is parallel to said first mentioned elongated conveyor.

11. The apparatus of claim 10, wherein said chamber is elongated and is substantially horizontal between said first and second openings, said first mentioned elongated conveyor constituting the floor of said chamber.

12. The apparaus of claim 11, wherein said chamber has spaced apart first and second ends and said first and second openings are respectively located at said first and second ends.

13. The apparatus of claim 10, wherein said moving means further comprises means for moving said second conveyor back and forth in synchronism with said first mentioned conveyor.

14. The apparatus of claim 13, wherein said second conveyor constitutes a mobile roof of said chamber.

15. The apparatus of claim 10, wherein said second conveyor is laterally adjacent to said first mentioned conveyor.

16. The apparatus of claim 15, wherein said partition is laterally adjacent to said second conveyor and is parallel to the rod-shaped articles in said chamber.

17. The apparatus of claim 10, wherein said second conveyor comprises two discrete conveyors flanking said chamber and said partition is disposed between said discrete conveyors.

18. The apparatus of claim 2, wherein said wall means further comprises a mobile floor for said chamber and said partition includes a deformable portion adjacent to said floor.

19. The apparatus of claim 18, wherein said deformable portion includes bristles.

20. The apparatus of claim 2, wherein said partition includes a deformable curtain.

21. The apparatus of claim 20, wherein said curtain comprises a plurality of rod-shaped members extending transversely of said chamber and substantially parallel to the articles in said path, and means for articulately connecting said members to each other.

22. The apparatus of claim 2, wherein said wall means further comprises a mobile floor for said chamber and said partition comprises a deformable portion contacting said floor in said first positions of said partition.

23. The apparatus of claim 2, further comprising a third machine for receiving articles which issue from said chamber by way of said second opening.

24. The apparatus of claim 23, wherein said third machine includes means for storing rod-shaped articles issuing from said chamber by way of said second opening.

25. The apparatus of claim 24, wherein said storing means includes trays.

26. The apparatus of claim 2, further comprising means defining a second path for sidewise movement of articles issuing from said chamber by way of said second opening.

27. The apparatus of claim 2, further comprising a third machine actuatable to receive articles issuing from said chamber by way of said second opening, and means for actuating said third machine in response to movement of said partition to said second position.

28. The apparatus of claim 27, wherein said actuating means comprises switch means disposed in the path of movement of said partition to said second position.

29. The apparatus of claim 2, wherein said moving means includes means for monitoring the articles in said junction zone.

30. The apparatus of claim 29, wherein said monitoring means includes a mobile sensor resting on the articles in said junction zone.

31. A reservoir, particularly for rod-shaped articles which constitute or form part of smokers' products, comprising wall means defining an elongated chamber having spaced-apart first and second openings and including a partition disposed in said chamber and movable between a plurality of first positions in each of which said openings are separated from each other and at least one second position in which said openings communicate with one another; means moving said partition between said positions; and means for moving said wall means in a direction to transport articles from said first opening, through said chamber and into said second opening for irreversible evacuation from said chamber via said second opening in the second position of said partition.

32. The reservoir of claim 31, wherein said wall means further comprises a mobile floor for said chamber, said means for moving said wall means comprising means for moving said floor in synchronism with said partition.

33. The reservoir of claim 32, wherein said mobile floor includes an endless belt conveyor having an elongated upper reach extending between said openings.

34. The reservoir of claim 33, wherein one of said openings is located at the general level of said upper reach and the other of said openings is located at a level above said upper reach.

35. The reservoir of claim 32, wherein said partition includes a deformable lower portion contacting said upper reach in said first positions of said partition.

* * * * *